US009072954B2

(12) United States Patent
Riggle

(10) Patent No.: US 9,072,954 B2
(45) Date of Patent: Jul. 7, 2015

(54) BATTING PRACTICE APPARATUS

(71) Applicant: Strike Tec System, LLC, Louisville, KY (US)

(72) Inventor: David Riggle, Louisville, KY (US)

(73) Assignee: STRIKE TEC SYSTEM, LLC, Louisville, KY (US)

( * ) Notice: Subject to any disclaimer, the term of this patent is extended or adjusted under 35 U.S.C. 154(b) by 0 days.

(21) Appl. No.: 14/176,581

(22) Filed: Feb. 10, 2014

(65) Prior Publication Data

US 2014/0228156 A1 Aug. 14, 2014

Related U.S. Application Data

(60) Provisional application No. 61/763,758, filed on Feb. 12, 2013.

(51) Int. Cl.
*A63B 69/00* (2006.01)
*A63B 43/00* (2006.01)

(52) U.S. Cl.
CPC ..... *A63B 69/0088* (2013.01); *A63B 69/0002* (2013.01); *A63B 2069/0008* (2013.01); *A63B 2043/001* (2013.01)

(58) Field of Classification Search
CPC ..... A63B 69/0088
USPC ..... 473/138–149, 422–430, 457, 506–508; 119/708, 792–799; 4/255.01–255.12; 482/114–120; 134/8; 42/95; 188/129, 188/377; 182/5, 235; 267/141, 201
See application file for complete search history.

(56) References Cited

U.S. PATENT DOCUMENTS

| | | | | | |
|---|---|---|---|---|---|
| 2,547,776 | A * | 4/1951 | Rankin | 473/424 |
| 2,705,634 | A * | 4/1955 | Sampson et al. | 267/203 |
| 3,115,346 | A * | 12/1963 | Pohle | 473/143 |
| 3,376,037 | A * | 4/1968 | Lepselter | 473/425 |
| 3,380,738 | A * | 4/1968 | Papp | 473/427 |
| 3,731,925 | A * | 5/1973 | Caldwell | 473/424 |
| 4,054,120 | A * | 10/1977 | Foley | 124/62 |
| 4,600,190 | A * | 7/1986 | Berokoff | 482/129 |
| 5,273,277 | A | 12/1993 | Freese | |
| 6,837,808 | B1 * | 1/2005 | Hatch | 473/424 |
| 7,691,013 | B2 * | 4/2010 | Emerson | 473/459 |
| 2004/0248676 | A1 | 12/2004 | Taylor et al. | |
| 2006/0014597 | A1 * | 1/2006 | Cantu et al. | 473/422 |
| 2010/0304900 | A1 | 12/2010 | Gu | |
| 2011/0016649 | A1 * | 1/2011 | Reggio et al. | 15/104.16 |

OTHER PUBLICATIONS

The United States Patent and Trademark Office; The International Search Report and the Written Opinion of the International Searching Authority, or the Declaration; International Search Report and Written Opinion; May 30, 2014; pp. 1-16; United States Patent and Trademark Office as Searching Authority; USA.

* cited by examiner

*Primary Examiner* — Melba Bumgarner
*Assistant Examiner* — Laura L Davison
(74) *Attorney, Agent, or Firm* — Wyatt, Tarrant & Combs, LLP; Stephen C. Hall

(57) ABSTRACT

A batting practice apparatus is arranged with a handle to be grasped by one person so a second person can practice hitting a ball, wherein the person grasping the apparatus positions the ball in a desired location and, when the second person strikes the ball with a bat, the kinetic energy associated with hitting the ball is dissipated, and the ball travels a reduced distance after being struck without having to pursue the ball a significant distance to retrieve it.

21 Claims, 7 Drawing Sheets

BATTING PRACTICE APPARATUS

CROSS-REFERENCE TO RELATED APPLICATIONS

This nonprovisional patent application claims priority to and benefit under 35 U.S.C §119(e) from U.S. Provisional Patent Application Ser. No. 61/763,758, filed on Feb. 12, 2013.

FIELD OF INVENTION

The subject application concerns an apparatus for presenting a ball, e.g. a softball or baseball, to a hitter so the hitter can practice hitting the ball with a bat.

BACKGROUND

Baseball and softball are popular sports in the U.S. and around the world. Participants in these sports desire to practice hitting a ball, and often the practice involves hitting the ball a significant distance. In live game situations, frequently the batter desires to hit the ball a long distance, but great distances are not necessarily conducive to efficient practice. In short, hitting the ball a long way in practice requires the hitter or someone else to also pursue the ball for a significant distance and retrieve it before the next practice swing can be taken. Also, the farther a ball travels after being hit, the more likely it will strike a person or object and cause injury or property damage.

Various approaches have been taken to limit the distance a ball travels after it is hit during practice. For example, some hitters take practice in front of a solid object that stops the ball, such as a net, wall, or fence. These approaches are not ideal for a number of reasons, including because the ball may miss the net, and the ball may damage the wall or fence, or injure a person.

Aside from safety considerations, other approaches have been tried to make batting practice more efficient. For example, some hitters practice hitting from a batting tee. A batting tee can be adjusted to practice swinging at high pitches and low pitches. But a batting tee cannot be adjusted laterally to practice hitting inside and outside pitches. Also, hitting from a batting tee does not solve the concerns noted above about retrieving the ball, and the relationship between the distance the ball travels and the possibility of injury or property damage. Another approach involves a flexible stick with a ball-like object fixably attached at the end. The ball-like object is presented to the hitter, and after the bat makes contact, the object and flexible stick move together. Although the object does not usually travel great distances, this does not provide the same feel of hitting an actual ball. Further, the ball-like object is usually made of a harder material than an actual ball, which can damage the bat. With the expensive bats that are sold, a damaged or broken bat is a significant expense.

Accordingly, there is a need for a batting practice apparatus that limits the distance the ball travels after it is hit, that allows the hitter to swing at an actual ball with full force, that reduces the possibility of injury and property damage from a hit ball, that can be used either on a ball field or in a more confined space, and that allows the hitter to practice swinging at a ball positioned in various locations, e.g., low, high, inside, and outside pitches.

SUMMARY OF INVENTION

The embodiments described herein meet the objectives stated in the previous section, while creating an efficient and reliable way for the ball to be returned to the general practice area. Unlike hitting a ball from a traditional batting tee, or from a pitcher conducting batting practice, with present embodiments the distance the ball travels after being hit is limited. Because the ball is attached to the apparatus via a string and the apparatus limits the distance it travels after being hit, due to the dissipation of kinetic energy associated with hitting the ball, one does not have to pursue the ball a significant distance to retrieve it.

In certain embodiments, kinetic energy is dissipated by a plunger indirectly connected to the ball by a string. The plunger is positioned within a hollow body member, wherein the outer dimension (e.g., diameter) of the plunger is approximately of equal size, either actually or effectively, as the hollow portion of the hollow body member. In other words, because the ball and the plunger are directly or indirectly attached to the same string at different points, as the ball travels after being hit it causes the plunger to move in the same direction within the hollow body member. As this occurs, and because the plunger is compressed as described herein, the plunger expands outward. What is meant by approximately of equal size, effectively, is that even if the plunger's diameter or other outer dimension is slightly less than the inner dimension (e.g., diameter) of the hollow body member, friction from contact against the inner surface of the hollow body member will occur as the plunger moves with the string, is compressed, and undergoes outward expansion. As it does so, its outer dimension will increase to the size of the inner dimension of the hollow body member.

Accordingly, the plunger, the hollow body member, and the string are operatively engaged to cause compression of the plunger when a pulling force is exerted on the string, for example when a ball is forcibly struck to which the string is attached Consequently, the compression of the plunger results in an increase of the diameter of the plunger, producing increased friction between the plunger and the inner surface of the hollow body member.

Because the plunger is approximately of equal diameter or dimension to the hollow portion of the hollow body member, it creates a friction force upon contact with the inner surface of the hollow body member. This force dissipates energy, resists movement of the plunger, and consequently slows the ball which is at a distal segment of the string. Furthermore, being indirectly connected to the plunger via the string, the movement of the ball is thus restricted.

In certain embodiments, the hollow body member comprises a shaft that can resemble a cylindrical tube opened at both ends, and the plunger is cylindrical and made of compressible material, such that the force of the ball being hit pulls the string and causes the plunger to compress. As the plunger compresses, it shortens the plunger longitudinally and expands the outer diameter. When the ball is hit, a close fit results between the outer diameter of the plunger and the inner surface of the hollow body member as the plunger is being pulled by the string. This also produces air resistance to slow the plunger as it travels through the hollow body member. Additional features of the present embodiments that cause the dissipation of energy and that limit the distance the ball travels after being hit are described below.

BRIEF DESCRIPTION OF THE DRAWINGS

The drawings and embodiments described herein are illustrative of multiple alternative structures, aspects, and features of the present embodiments, and they are not to be understood as limiting the scope of present embodiments. It will be further understood that the drawing figures described and provided herein are not to scale, and that the embodiments are not limited to the precise arrangements and instrumentalities shown.

MULTIPLE EMBODIMENTS AND ALTERNATIVES

Figure 1:
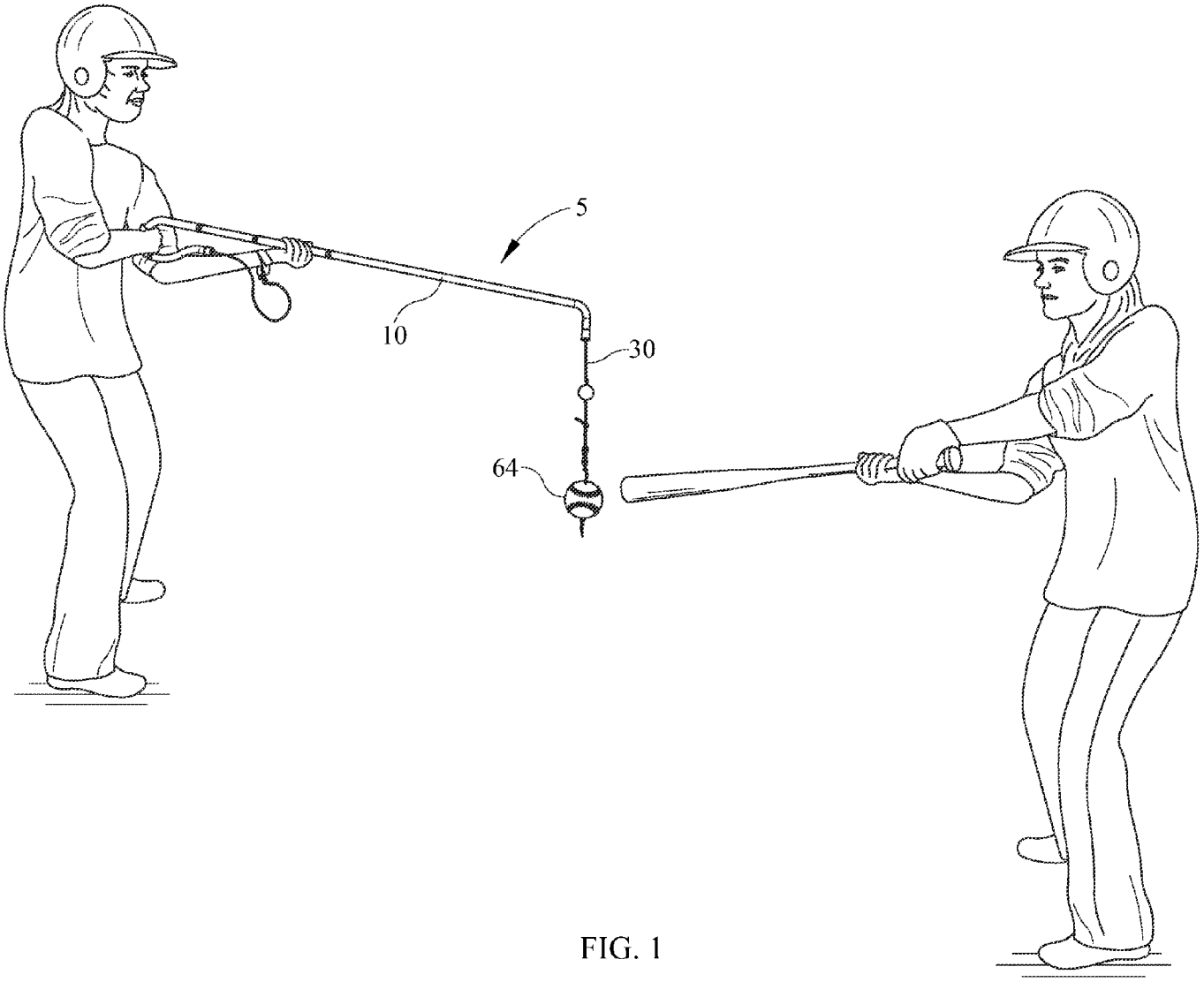
FIG. 1 is a perspective view of a batting practice apparatus as it could be used for practice, according to multiple embodiments and alternatives.

FIG. 1 shows the basic arrangement for a batting practice apparatus 5 according to multiple embodiments and alternatives. A practice partner holds the hollow body member 10 while the practicing hitter stands a suitable distance away. Though not limited to these dimensions, in certain embodiments hollow body member 10 is formed from ¾-inch outer diameter tubing, is substantially hollow, has openings at both ends, and is about 3-5 feet in length.

As will be seen in later figures, a first segment of string 30 runs through, i.e., traverses, the inside of hollow body member 10, and at least one other segment protrudes from an opening of hollow body member 10. A ball 64 is suspended at an end of this other segment of the string, and is thus presented to the hitter. The practice partner can hold the ball low, high, or to the inside or outside of the hitter. This allows the hitter to take a variety of swings without having to adjust a batting tee.

Figure 2:
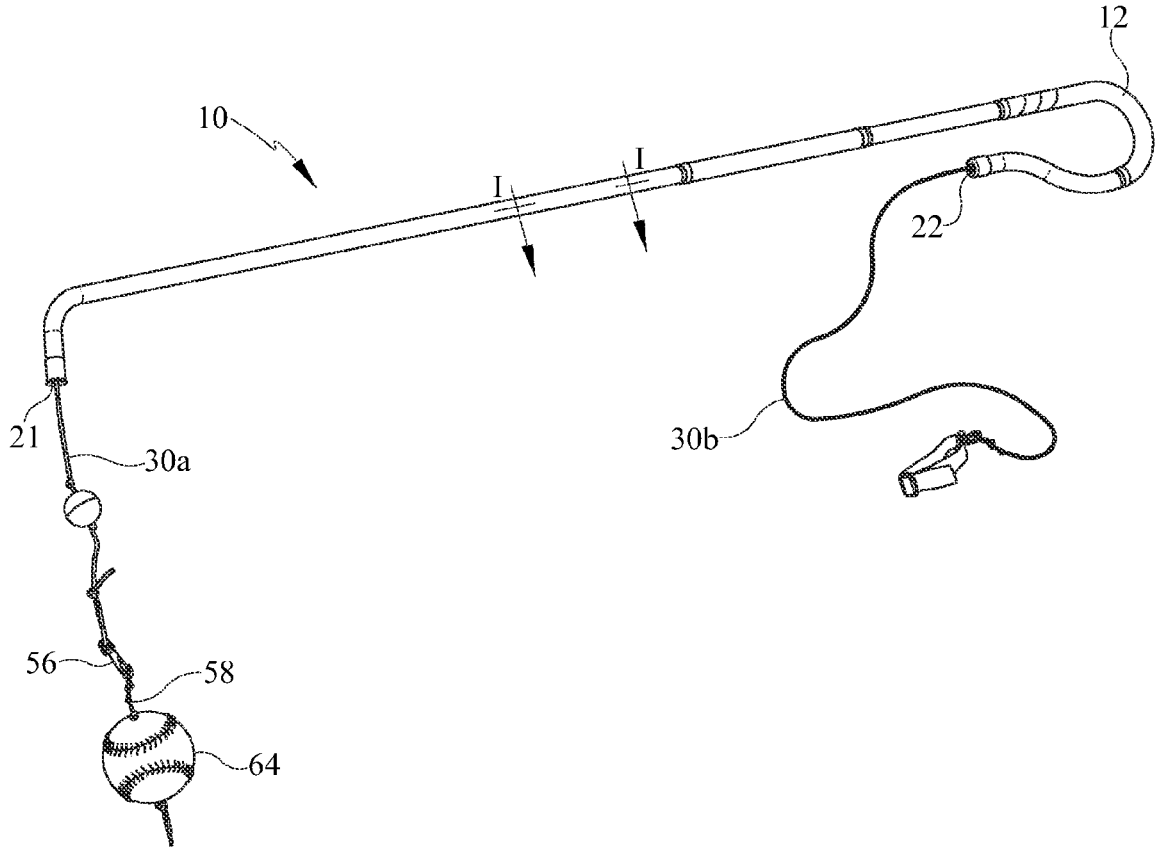
FIG. 2 is a perspective view of a batting practice apparatus, according to multiple embodiments and alternatives.

Embodiments such as shown in FIG. 2 include a hollow body member 10 having a first opening 21 proximal to ball 64 and a second opening 22 proximal to handle 12, which was shown being grasped by the practice partner in FIG. 1. A segment 30*a* of string 30 is visible below opening 21, and a different segment 30*b* of string 30 is shown at the other end of hollow body member 10 proximal to opening 22. Preferably, string 30 is a single strand, but alternatively string 30 comprises a plurality of strands.

FIG. 2 also shows string extension 58, which is seen as a separate strand joined to a clasp 56 attached to string 30. In the pictured embodiment, ball 64 is attached to string extension 58. This arrangement allows different kinds of balls to be quickly switched out. For example, a string extension 58 with a baseball at one end can readily be unclasped, and another string extension 58 with a different ball, for example a softball, can be joined to clasp 56. Thus, ball 64 is at least indirectly attached to string 30 via the string extension 58. Optionally, one may forego string extension 58 and clasp 56, in order to directly attach ball 64 to string 30, and specifically to segment 30*a*.

Hollow body member 10 can be formed from various materials. Preferably, the material(s) will combine suitable structural integrity for durability, but without being rigid, for example chlorinated polyvinyl chloride. In certain embodiments, a suitable coating is applied to the outer surface of hollow body member 10 to limit exposure to ultraviolet rays. Preferably, hollow body member 10 is a single piece, but optionally this member can represent a plurality of pieces that are joined together.

Likewise, the present embodiments are not limited by the materials chosen for string 30. For example, actual string or thin-gauged wire can be used, but preferably string 30 is formed from flexible nylon. Preferably, string extension 58 is formed from the same choice of materials.

Figure 3:
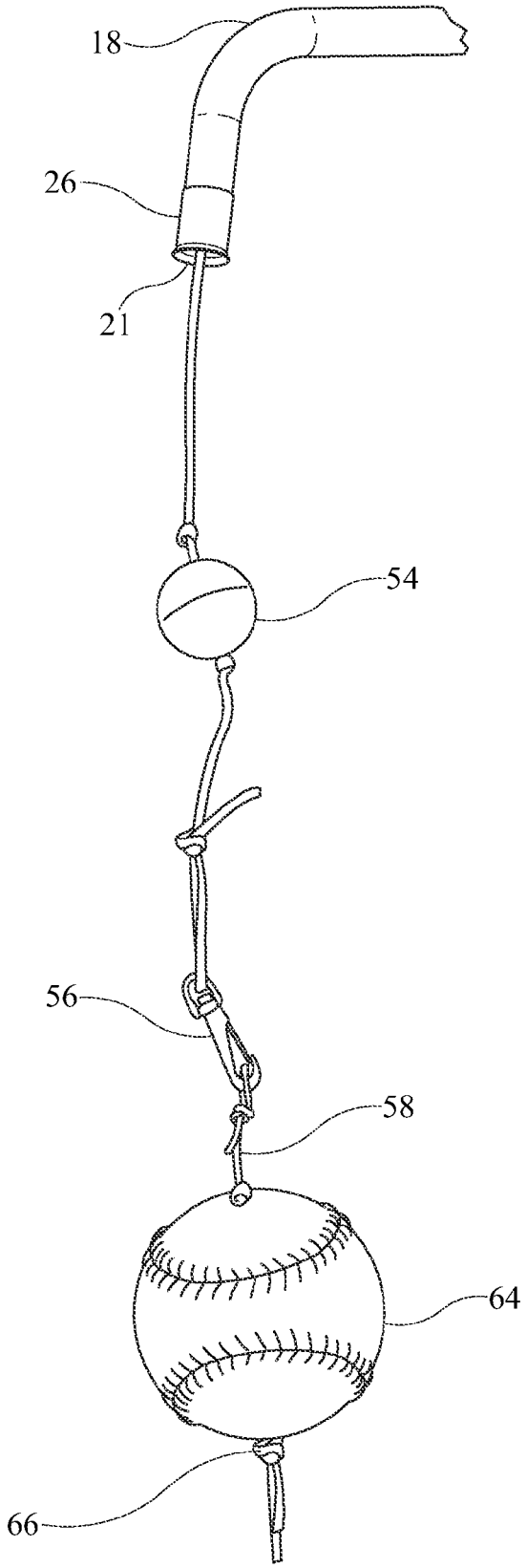
FIG. 3 is a perspective view of part of a batting practice apparatus at a first end (including the neck), according to multiple embodiments and alternatives.

As several figures illustrate, including FIG. 3, hollow body member 10 has a neck 18 proximal to first opening 21. Neck 18 may have a bend radius up to 90°. The length of hollow body member 10, including the portion between neck 18 and first opening 21, may vary as selected by a user. In general, the bend puts the ball in a more natural position to hang down in front of the hitter. After the ball is hit, a force is placed on string 30 that is substantially perpendicular to the inside wall of hollow body member 10 and this creates additional resistance to the movement of the string. FIG. 3 also illustrates a support piece 26, which in certain embodiments is a metal piece in the form of a truncated cone welded to the end of hollow body member 10. The force of hitting ball 64 attached to string extension 58 causes string 30 to rapidly pull in a first direction 28, shown in FIG. 5A, as the ball moves away from hollow body member 10. This could cause abrasion on the inner diameter of the rim of opening 21 which over time would reduce the life of hollow body member 10. Instead, the edges of string 30 rub against the more durable metal of support piece 26, and this limits abrasion wear on the inner diameter of hollow body member 10.

FIG. 3 also shows a stop 54, which prevents ball 64 from contacting the opening 21 of hollow body member 10. This is significant mainly for the process of reloading the apparatus after a ball is hit, which is discussed further below. Also, ball 64 can be a conventional baseball, softball, or other ball that a player wants to hit with a bat or similar object. The embodiments provide the option of practicing hitting with the same ball that is used in a game.

In certain embodiments, a hole is drilled (obscured in the drawing figures, but generally from top of ball to bottom of ball) diametrically through the ball, and runs string 30 through the hole. Optionally, a plastic tube is inserted through the drilled-out space in the ball, which helps reduce compression on the inside of the ball as it is repeatedly struck. In FIG. 3, a terminal knot 66 (not claimed) is formed in string extension 58 and is used to secure the ball to string extension 58, which is shown having been joined to clasp 56 as discussed above.

Figure 4:
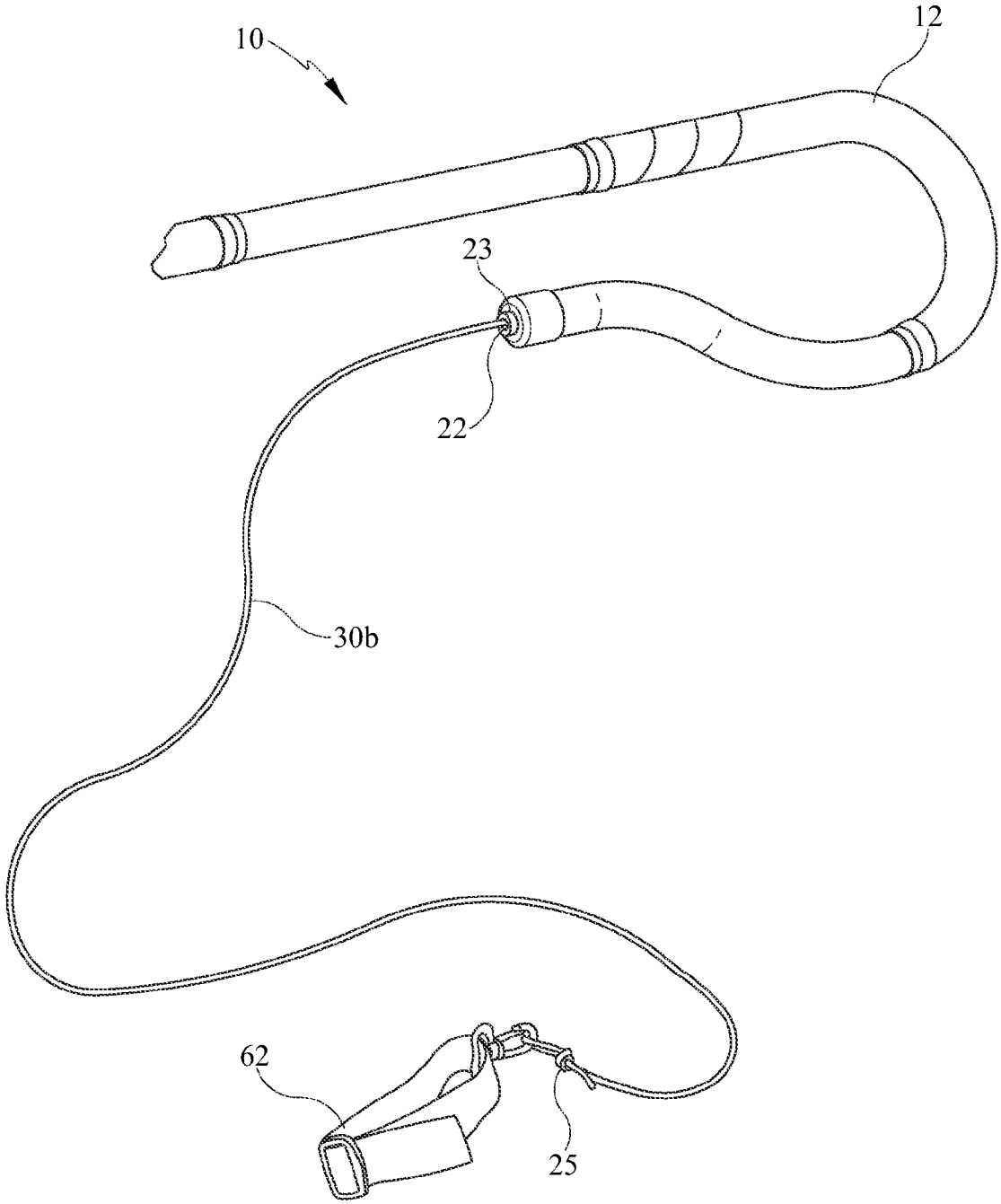
FIG. 4 is a perspective view of part of a batting practice apparatus at a second end (including the handle), according to multiple embodiments and alternatives.

FIG. 4 illustrates part of a batting practice apparatus at a second end (including curved handle 12), according to multiple embodiments and alternatives. As shown, string segment 30*b* is outside the hollow body member 10 proximal to second opening 22. In certain embodiments, plate 23 is fixably attached to the terminus of handle 12, such that a hole formed in plate 23 overlaps opening 22. Optionally, a handle knot 25 or other fixed solid object is formed integral with string segment 30*b*. Thus, when the ball is hit and string 30 is forcibly moved in a first direction 28 (shown in FIG. 5), range of motion limiting means are provided in some embodiments to prevent the plunger from exiting the hollow body member. In some embodiments, range of motion limiting means comprise a handle knot 25, which contacts plate 23 and stops the movement of the string 30 in the first direction 28, thus preventing plunger 32 from exiting the hollow body member at opening 21. Accordingly, in certain embodiments, the length of string 30 and the positioning of range of motion limiting means (e.g., handle knot 25) limit how far the string will travel after the ball is hit. FIG. 4 also illustrates a strap 62 that can be worn by the practice partner while holding the apparatus, which reduces the chance of losing one's grip on handle 12.

Figure 5A:
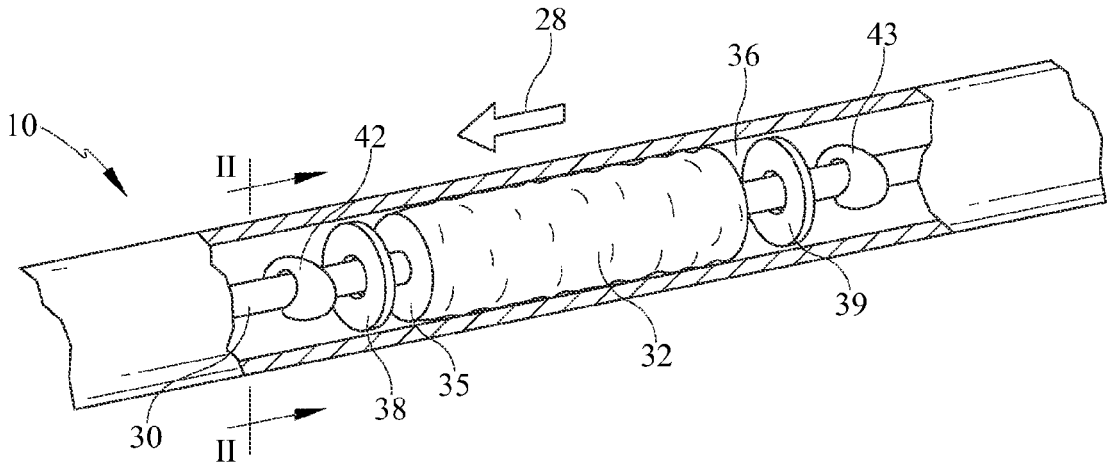
FIG. 5A provides a sectional view of a batting practice apparatus taken along the line I-I shown in FIG. 2, according to multiple embodiments and alternatives.

FIG. 5A illustrates a cross-section, taken along line I-I in FIG. 2, of hollow body member 10 with plunger 32 positioned inside the hollow space. A primary purpose of plunger 32 is dissipating kinetic energy when the ball is hit. Accordingly, plunger 32 is positioned within hollow body member 10 and operatively engaged with string 30, such that a pulling force exerted on the string in first direction 28 is translated to the plunger causing the plunger to travel in the first direction. Without limiting the scope of the range of embodiments, in certain embodiments, as FIG. 5A illustrates, operative engagement of plunger 32 with string 30 involves forming a hollow space (not pictured) longitudinally through the entire length of plunger 32 and traversing string 30 through the plunger.

In certain embodiments, plunger 32 is formed from a compressible material, e.g., foam. Preferably, the shape of plunger 32 is cylindrical, but other shapes are suitable as well, e.g., spherical. Although present embodiments are not limited by the shape or dimensions of the plunger 32, preferably it is about one and half to two inches long. In certain embodiments, plunger 32 comprises a first end 35 and a second end 36, with a hollow space through its longitudinal length, such that string 30 traverses the interior of plunger 32 longitudinally from first end 35 to second end 36. For example, in certain embodiments, a small-diameter hole (not illustrated) is formed in plunger 32 from first end 35 to second end 36, through which string 30 is inserted. Also, in certain embodiments, a first interior knot 42 is formed in string 30 proximal to first end 35, and a second interior knot 43 is formed in string 30 proximal to second end 36. Knots 42, 43 keep the tension in string 30 focused at the ends of plunger of 32, and generally help to align the plunger.

Figure 7:
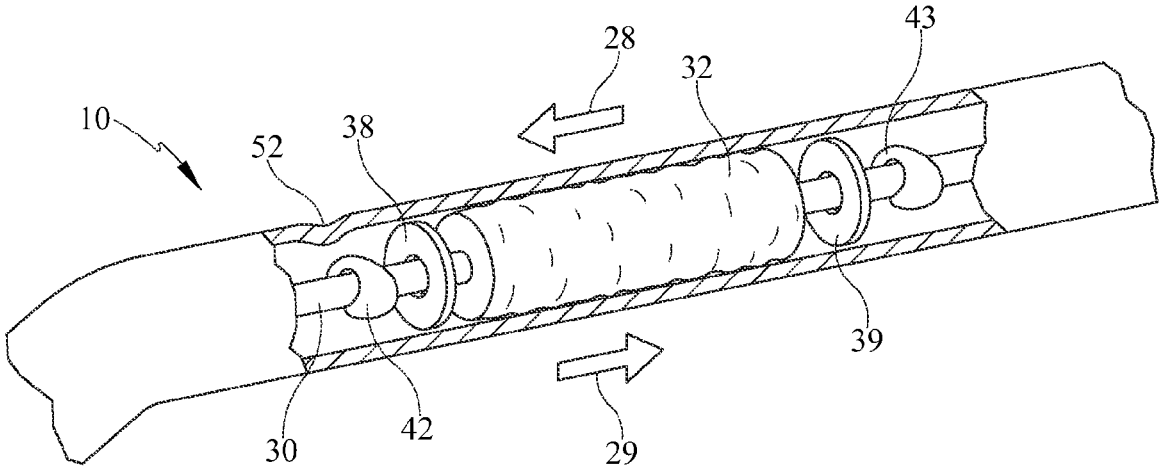
FIG. 7 provides a sectional view of a batting practice apparatus taken along the line III-III in FIG. 6, according to multiple embodiments and alternatives.

It will be understood that various structures seen in FIG. 5A and FIG. 7 will be in contact because of compression and tension placed on string 30 from striking the ball. In certain embodiments, these will include first interior knot 42 in contact with a compressing member 38, member 38 in contact with first end 35 of plunger 32, second end 36 of plunger in contact with another compressing member 39, and member 39 in contact with second interior knot 43. For purposes of illustration and to aid with clarity, these are presented in FIG. 5A and FIG. 7 with slight gaps between each member so as to better distinguish the structures. In operation, however, the velocity of plunger 32 lags that of ball 64 and string 30, causing the plunger and compressing member(s) to bunch together as the plunger compresses and expands outward to contact the inner surface of hollow body member 10.

In certain embodiments, compressing member 38 is positioned between first end 35 and first interior knot 42. Similarly, a second compressing member 39 is positioned between plunger second end 36 and second interior knot 43. In certain embodiments, compressing members 38, 39 are generally formed from a solid material comprising metal or hard plastic. Some embodiments utilize both compressing members 38, 39, as arranged according to the above discussion. Alternatively, only one such compressing member is utilized. For embodiments utilizing only one compressing member, preferably it is compressing member 39.

As string 30 is pulled in a first direction 28, which can happen forcibly such as when the ball is hit, it causes plunger 32 to move in the same direction. Further, compressing member 39 is configured to contact and compress the plunger when a pulling force is exerted on the string in this first direction, i.e., when the ball is hit. Thus, as string 30 is caused to be forcibly pulled in first direction 28, a proportional force is placed on compressing member 39 that translates to second end 36 of plunger 32, which causes plunger 32 to compress. The pulling force being generated by the movement of the ball 64 is translated proportionally to the plunger via string 30. In turn, the diameter of plunger 32 increases as it is compressed, thus increasing the friction between the plunger and the inner surface of the hollow body member.

Figure 5B:
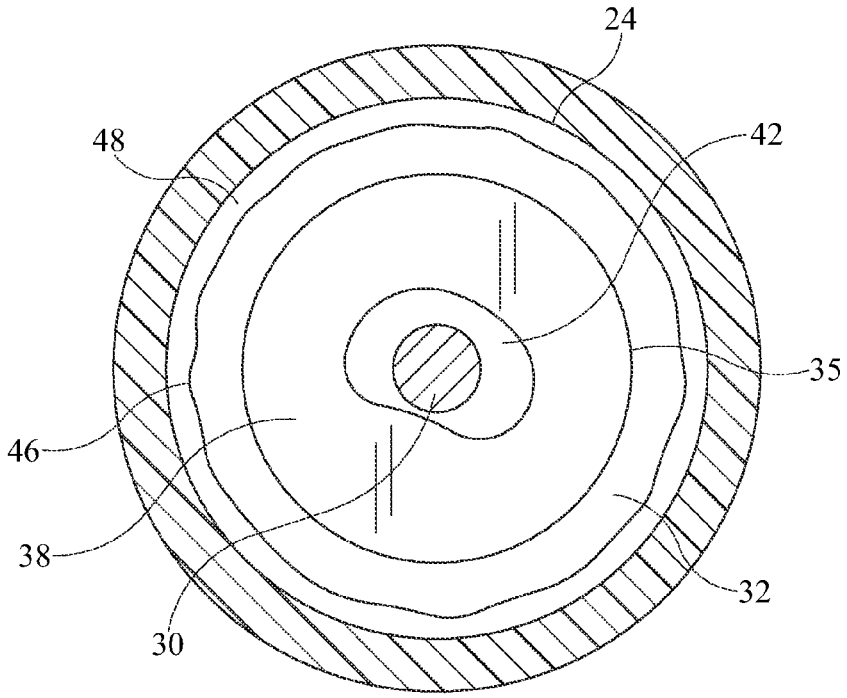
FIG. 5B is a sectional view of several structures contained in a batting practice apparatus, taken along the line II-II shown in FIG. 5A, according to multiple embodiments and alternatives.

Taken together, FIG. 5A and FIG. 5B illustrate and describe how the compression force on plunger 32 causes longitudinal shortening, thus expanding the diameter of the outer surface 46 of plunger 32. Compression arises due in part to striking the ball, which produces a velocity differential between string 30 having a much greater velocity than the velocity of plunger 32. The velocity differential in turn increases the force translated to second end 36 of plunger 32. Further, in certain embodiments plunger 32 is formed from material of lesser hardness than the compressing member 39 (visible in FIG. 5A) which increases the compressive effects exerted upon the plunger. Further, as friction against inner surface 24 slows the expanded plunger 32 relative to the velocity of string 30, further compression of the plunger occurs.

The relationships are such that the greater the velocity of string 30, i.e., the harder the ball is hit, the greater the force translated to second end 36 of plunger 32 to move the plunger, and the greater the compression-related longitudinal shortening and expansion outward of plunger 32. This in turn produces more friction force against inner surface 24, thus slowing plunger 32 and further increasing the velocity differential. Thus, it will be appreciated that compressing member 39 is not only positioned within the hollow body member 10 between the plunger 32 and the handle (see FIG. 2), but also operatively engaged with string 30, such that a pulling force exerted on the string in a first direction 28 is translated to compressing member 39 causing the compressing member to travel in the first direction. While not meant as limiting of the scope of the range of embodiments, in certain embodiments compressing member 39 (as well as, optionally when utilized, first compressing member 38) is a circular washer formed from metal or hard plastic, and its operative engagement with string 30 is established by virtue of the string being inserted through the opening in the washer combined with knot 43 which is formed in the string.

Much of the compression of plunger 32 originates from compressing member 39, but there are other sources. One of these is air resistance, given that the expanded plunger 32 is in contact with the inner surface 24 of hollow body member 10, air flow past the plunger in a direction opposite first direction 28 is restricted.

The sectional view of FIG. 5B, taken along line II-II in FIG. 5A, illustrates the relationships between plunger 32 and an inner surface 24 of hollow body member 10. The view is taken from first end 35 of plunger 32 and shows compressing member 38 and first interior knot 42. In certain embodiments, a space 48 exists between outer surface 46 of plunger 32 and inner surface 24 of hollow body member 10. Space 48 can range from substantially zero to a few millimeters. The scope of present embodiments is not limited by the quantity of space 48, but the space is preferably small enough that longitudinal shortening due to forces discussed above causes plunger 32 to expand, resulting in contact between outer surface 46 of plunger 32 and inner surface 24 of hollow body member 10. The friction force created by this contact is a primary factor in the dissipation of kinetic energy after the ball is hit.

The space 48 should be small enough that compression and longitudinal shortening of plunger 32 result in actual contact between the outer surface 46 and the inner surface 24 of hollow body member 10. If there is no such contact after the ball is hit, the plunger 32 will not dissipate any kinetic energy. However, the friction force should not be so great that movement of plunger 32 is restricted when string 30 is gently pulled.

Figure 6:
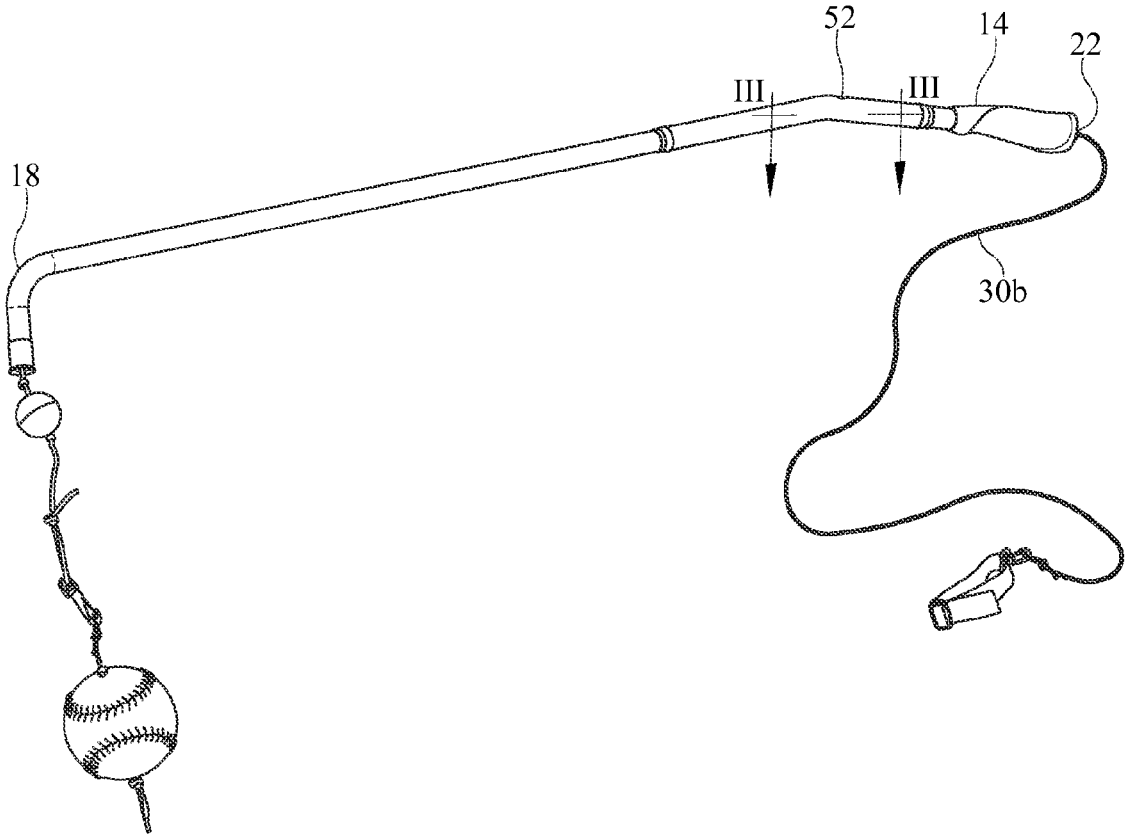
FIG. 6 is a perspective view of an alternative embodiment for a batting practice apparatus, according to multiple embodiments and alternatives.

FIG. 6 shows a second embodiment of hollow body member 10, having straight handle 14 instead of a curved handle. A dimple 52 is provided near handle 14 to serve as a catch point and temporary friction stop for the plunger 32 as it is being loaded. Loading the apparatus occurs by gently pulling on a segment of string 30 proximal to second opening 22 of hollow body member 10. Dimple 52 can also be used in the curved handle 12 embodiments previously described, in order to establish such a catch point. FIG. 6 also illustrates the optional curved neck 18 located distally to the handle.

FIG. 7 is a sectional view of hollow body member 10 taken along the line III-III (FIG. 6) in the vicinity of dimple 52, wherein plunger 32 is located between dimple 52 and opening 22 (best seen in FIG. 6). As also seen in FIG. 6, this position will generally result when a user (e.g., a practice partner holding the apparatus) pulls segment 30*b* away from opening 22, thus causing plunger 32 to also move in the direction of second directional arrow 29. Thus, it will be appreciated that second directional arrow 29 is associated with reloading the plunger 32 so that the ball can be struck, while first directional arrow 28 is associated with the movement of string 30 and plunger 32 after the ball is struck. FIG. 7 also illustrates several other structures seen in FIG. 5A, including but not limited to at least one compressing member 39, and in this illustration an additional compressing member 38, the positions of which are influenced by first knot and second knot 42, 43, respectively. In some embodiments, the end of plunger 32 that is proximal to compressing member 38 rests in contact with dimple 52 when reloading concludes. Alternatively, compressing member 38 itself rests in contact with dimple 52 to temporarily hold the position of plunger 32. Accordingly, FIG. 7 illustrates the interior of hollow body member 10 when the apparatus is in the loaded position.

The act of striking the ball generally results in greater force upon string 30 (and thus greater velocity) in first direction 28 than the act of reloading the plunger in second direction 29. By reloading to the point where plunger 32 moves past dimple 52, it provides a catch point which serves to interfere with movement of plunger 32 in first direction 28. In similar fashion as discussed above with respect to movement in the first direction, 28, compression and tension placed on string 30 from contact between first interior knot 42, compressing member 38, and plunger 32, being pulled in a second direction 29, also translate the pulling force to plunger 32 during reloading.

As previously mentioned, a stop 54 (see FIG. 3 and related discussion, above) can be used to prevent ball 64 from contacting the opening 21 of hollow body member 10, i.e., to prevent string 30 from being pulled too far in second direction 29 during reloading. As plunger 32 is being loaded, string 30 need only be gently pulled in second direction 29. With plunger 32 loaded and in ready position, the temporary friction stop counteracts the effects of gravity and the weight of the ball 64 pulling on string 30 to keep plunger 32 in position until the ball is struck. Dimple 52 thus is as a protrusion into the interior hollow space of the hollow body member, for achieving a temporary friction stop, which serves as a catch point created by dimple 52. This feature is optional, as a practice partner can also hold segment 30 which is shown in FIG. 6 until ball 64 is hit.

Accordingly, the plunger's position can also be temporarily held by configuring the plunger and the inner surface of hollow body member 10 to maintain a temporary friction stop (i.e., interference fit) through friction forces. That is, the temporary friction stop exists until a pulling force is applied to the string in first direction 28, and thereby translated to plunger 32 in excess of the force of the temporary friction stop. As stated above, such a force is typically created by forcibly striking ball 64 during practice.

Alternatives exist to dimple 52, with respect to structures that protrude into the interior hollow space of the hollow body member, for achieving a temporary friction stop. For example, an interference rib (not illustrated), which the plunger rests against in the loaded configuration, can be formed integrally with the inside surface of hollow body member 10. The end of plunger 32 that is proximal to compressing member 38, or the compressing member 38 itself, rests against said rib. In some embodiments, the rib provides sufficient interference to hold the plunger's position, but that resistance is in turn easily overcome by a pulling force exerted on the string in first direction 28, such as by the movement of ball 64 that is directly or indirectly attached to string 30 when the ball is forcibly struck.

It will be understood that the embodiments described herein are not limited in their application to the details of the teachings and descriptions set forth, or as illustrated in the accompanying figures. Rather, it will be understood that the present embodiments and alternatives, as described and claimed herein, are capable of being practiced or carried out in various ways.

Also, it is to be understood that words and phrases used herein are for the purpose of description and should not be regarded as limiting. The use herein of "including," "comprising," "e.g.," "containing," or "having" and variations of those words is meant to encompass the items listed thereafter, and equivalents of those, as well as additional items.

Accordingly, the foregoing descriptions of several embodiments and alternatives are meant to illustrate, rather than to serve as limits on the scope of what has been disclosed herein. The descriptions herein are not intended to be exhaustive, nor are they meant to limit the understanding of the embodiments to the precise forms disclosed. It will be understood by those having ordinary skill in the art that modifications and variations of these embodiments are reasonably possible in light of the above teachings and descriptions.

What is claimed is:

1. A batting practice apparatus, comprising;

a ball, wherein the ball is selected from the group consisting of baseball and softball;

a substantially hollow body member having an inner surface, a handle, a first opening distal to the handle, and a second opening proximal to the handle;

a string having a first segment traversing an interior hollow space of the hollow body member a longitudinally a second segment protruding out of the hollow body member from the first opening, and a third segment protruding out of the hollow body member from the second opening, wherein the string is directly or indirectly attached to a ball, and wherein striking the ball produces movement of the first segment of string in a first direction;

a plunger formed of compressible material positioned within the hollow body member and having a length and a hollow space through the length of the plunger, wherein the first segment of string traverses the hollow space within the plunger; and a compressing member positioned within the hollow body member between the plunger and the handle and configured to contact and compress the plunger;

wherein the plunger, the compressing member, the hollow body member, the string, and the ball are operatively engaged such that a pulling force exerted on the string in the first direction is translated to the plunger to cause compression and longitudinal shortening of the plunger when the pulling force is exerted on the string in the first direction, thereby increasing the diameter of the plunger and producing increased friction between the plunger and the inner surface of the hollow body member, thereby producing a lag in the velocity of the plunger relative to the velocity of the ball and string as the plunger expands and contacts the inner surface of the hollow body member.

2. The batting practice apparatus of claim 1, wherein the hollow body member comprises a cylindrical shaft.

3. The batting practice apparatus of claim 2, wherein the cylindrical shaft includes a curved neck having a bend radius up to 90°.

4. The batting practice apparatus of claim 2, wherein the plunger is of approximately equal diameter as the inner diameter of the hollow body member, and contact between the plunger and the hollow body member restricts air flow past the plunger in a direction opposite the first direction.

5. The batting practice apparatus of claim 2, wherein the plunger is substantially cylindrical and formed from compressible material of lesser hardness than the compressing member.

6. The batting practice apparatus of claim 1, further comprising a string extension joined to a clasp attached to the second segment of the string.

7. The batting practice apparatus of claim 6, configured to allow the read substitution of one ball for another.

8. The batting practice apparatus of claim 1, wherein the third segment of string is formed with range of motion limiting means to prevent the plunger from exiting the hollow body member.

9. The batting practice apparatus of claim 1. wherein movement of the third segment of string in a second direction, generally opposite the first direction, causes the plunger to also move in the second direction.

10. The batting practice apparatus of claim 1, wherein the hollow body member further comprises a protrusion into the interior hollow space forming a temporary friction stop securing the position of the plunger between the protrusion and the handle.

11. The batting practice apparatus of claim 10, wherein the hollow body member comprises a cylindrical shaft.

12. The batting practice apparatus of claim 11, wherein the cylindrical shaft includes a curved neck having a bend radius up to 90°.

13. The batting practice apparatus of claim 10, wherein the plunger and the string are operatively engaged such that movement of the third segment of string in a second direction, generally opposite the first direction, causes the plunger to also move in the second direction.

14. A batting practice apparatus, comprising:

a ball, wherein the ball is selected from the group consisting of baseball and softball;

a substantially hollow body member having an inner surface, a handle, and at least one opening positioned distal to the handle;

a string having a first segment traversing an interior hollow space of the hollow body member longitudinally, and a second segment protruding out of the hollow body member from the at least one opening, wherein the string is directly or indirectly attached to the ball, and wherein striking the bail produces movement of the first segment of string in a first direction;

a plunger formed of compressible material positioned within the hollow body member and having a length and a hollow space through the length of the plunger, wherein the first segment of string traverses the hollow space within the plunger; and a compressing member positioned within the hollow body member between the plunger and the handle and configured to contact and compress the plunger;

wherein the plunger, the compressing member, the hollow body member, the string, and the ball are operatively engaged such that a pulling force exerted on the string in the first direction is translated to the plunger to cause compression and longitudinal shortening of the plunger when the pulling force is exerted on the string in the first direction, thereby increasing the diameter of the plunger and producing increased friction between the plunger and the inner surface of the hollow body member, thereby producing a lag in the velocity of the plunger relative to the velocity of the ball and string a as the planner expands and contacts the inner surface of the hollow body member.

15. The batting practice apparatus of claim 14, wherein the hollow body member comprises a cylindrical shaft

16. The batting practice apparatus of claim 15, wherein the cylindrical shaft includes a curved neck having a bend radius up to 90°.

17. The batting practice apparatus of claim 14, wherein the plunger is of approximately equal diameter as the inner diameter of the hollow body member, and contact between the plunger and the hollow body member restricts air flow past the plunger in a direction opposite the first direction.

18. The batting practice apparatus of claim 14, further comprising a string extension joined to a clasp attached to the second segment of the string.

19. The batting practice apparatus of claim 18, configured to allow the ready substitution of one ball for another.

20. The batting practice apparatus of claim 14, further comprising a support:

piece surrounding the at least one opening for reducing abrasion on the hollow body member due to the movement of the string.

21. The batting practice apparatus of claim 20, wherein the plunger is substantially cylindrical and formed from compressible material of lesser hardness than the compressing member, and contact between the plunger and the hollow body member restricts air flow past the plunger in a direction opposite the first direction.

* * * * *